US006540595B1

(12) United States Patent
Birang

(10) Patent No.: US 6,540,595 B1
(45) Date of Patent: Apr. 1, 2003

(54) CHEMICAL-MECHANICAL POLISHING APPARATUS AND METHOD UTILIZING AN ADVANCEABLE POLISHING SHEET

(75) Inventor: Manoocher Birang, Los Gatos, CA (US)

(73) Assignee: Applied Materials, Inc., Santa Clara, CA (US)

( * ) Notice: Subject to any disclaimer, the term of this patent is extended or adjusted under 35 U.S.C. 154(b) by 39 days.

(21) Appl. No.: 09/652,232

(22) Filed: Aug. 29, 2000

(51) Int. Cl.[7] ..... B24B 29/00
(52) U.S. Cl. ..... 451/288; 451/287; 451/41
(58) Field of Search ..... 451/41, 296, 287, 451/307, 5, 6, 8, 9, 288, 289, 28

(56) References Cited

U.S. PATENT DOCUMENTS 6,036,586 A * 3/2000 Ward ..... 451/287
6,106,369 A * 8/2000 Konishi et al. ..... 451/287
6,241,583 B1 * 6/2001 White ..... 451/287
6,244,935 B1 * 6/2001 Birang et al. ..... 451/41
6,302,767 B1 * 10/2001 Tietz ..... 451/41
6,322,427 B1 * 11/2001 Li et al. ..... 451/288
6,358,118 B1 * 3/2002 Boehm et al. ..... 451/24
6,398,905 B1 * 6/2002 Ward ..... 451/288

* cited by examiner

*Primary Examiner*—Lee Wilson
(74) *Attorney, Agent, or Firm*—Moser, Patterson & Sheridan

(57) ABSTRACT

A chemical mechanical polishing apparatus has a rotatable platen, a generally linear polishing sheet having an exposed portion extending over a top surface of the platen for polishing the substrate, and a drive mechanism to incrementally advance the polishing sheet in a linear direction across a top surface of the platen. The apparatus includes a hydrophobic layer for substantially preventing aqueous liquid which penetrates under the polishing sheet from wetting a lower surface of the polishing sheet. The polishing sheet is releasably secured to the platen to rotate with the platen, and it has a width greater than a diameter of the substrate.

23 Claims, 7 Drawing Sheets

CHEMICAL-MECHANICAL POLISHING APPARATUS AND METHOD UTILIZING AN ADVANCEABLE POLISHING SHEET

TECHNICAL FIELD

The present invention relates to polishing of surfaces, such as semiconductor wafers, and more particularly, to an advanceable polishing sheet arrangement for chemical-mechanical polishing devices.

BACKGROUND ART

In the process of fabricating modem semiconductor integrated circuits (ICs), it is necessary to form various material layers and structures over previously formed layers and structures. However, the prior formations often leave the top surface topography of an in-process wafer highly irregular, with bumps, areas of unequal elevation, troughs, trenches, and/or other surface irregularities. These irregularities cause problems when forming the next layer. For example, when printing a photographic pattern having small geometries over previously formed layers, a very shallow depth of focus is required. Accordingly, it becomes essential to have a flat and planar surface, otherwise, some parts of the platen will be in focus and other parts will be out of focus. In fact, surface variations on the order of less than 100 angstroms over a 25×25 mm die would be preferable. In addition, if the irregularities are not leveled at each major processing step, the surface topography of the wafer can become even more irregular, causing further problems as the layers stack up during further processing. Depending on the die type and the size of the geometries involved, the surface irregularities can lead to poor yield and device performance. Consequently, it is desirable to effect some type of planarization, or leveling, of the IC structures. Most IC fabrication techniques make use of some method to form a planarized wafer surface at critical points in the manufacturing process.

One method for achieving semiconductor wafer planarization or topography removal is the chemical-mechanical polishing (CMP) process. In general, the CMP process involves holding and/or rotating the wafer against a rotating polishing platen under a controlled pressure. This planarization method typically requires that the substrate be mounted on a carrier or polishing head. The exposed surface of the substrate is placed against a rotating polishing pad. The polishing pad may be either a "standard" pad or a fixed-abrasive pad. A standard pad has a durable roughened surface, whereas a fixed-abrasive pad has abrasive particles held in a containment media. The carrier head provides a controllable load, i.e., pressure, on the substrate to push it against the polishing pad. A polishing slurry, including at least one chemically-reactive agent, and abrasive particles if a standard pad is used, is supplied to the surface of the polishing pad.

An effective CMP process not only provides a high polishing rate, but also provides a substrate surface which is finished (lacks small-scale roughness) and flat (lacks large-scale topography). The polishing rate, finish and flatness are determined by the pad and slurry combination, the relative speed between the substrate and pad, and the force pressing the substrate against the pad. The polishing rate sets the time needed to polish a layer, which in turn sets the maximum throughput of the CMP apparatus.

During CMP operations, the polishing pad needs to be replaced periodically. For a fixed-abrasive pad, the substrate wears away the containment media to expose the embedded abrasive particles. Thus, the fixed-abrasive pad is gradually consumed by the polishing process. After a sufficient number of polishing runs (e.g., forty to fifty) the fixed-abrasive pad needs to be replaced. For a standard pad, the substrate thermally and mechanically damages the polishing pad and causes the pad's surface to become smoother and less abrasive. Therefore, standard pads must be periodically "conditioned" to restore a roughened texture to their surface. After a sufficient number of conditioning operations (e.g., three hundred to four hundred), the conditioning process consumes the pad or the pad is unable to be properly conditioned. The pad must then be replaced. An advantage of fixed-abrasive polishing pads is that they do not need to be conditioned.

In the CMP process, the polishing pad may be attached to the platen surface with an adhesive. Significant physical effort is often required to peel the polishing pad away from the platen surface. The adhesive then must be removed from the platen surface by scraping and washing with a solvent. A new polishing pad can then be adhesively attached to the clean surface of the platen. While this is happening, the platen is not available for the polishing of substrates, resulting in a decrease in polishing throughput. The use of fixed-abrasive pads, which need to be replaced more often than standard polishing pads, result in an even further decrease in polishing throughput. Thus, although the fixed-abrasive pads do not need to be conditioned, the use of fixed-abrasive pads in a CMP apparatus results in a higher cost of operation.

SUMMARY

An aspect of the present invention is a chemical mechanical polishing apparatus, comprising:

a platen having a flat planar major surface, said platen being rotatable about an axis normal to said major surface;

a polishing sheet releasably secured to a top of said major surface of said platen to rotate with said platen, said polishing sheet extending over said top of said major surface of said platen and having an exposed surface for polishing a substrate; and a hydrophobic layer for substantially preventing aqueous liquid which penetrates under said polishing sheet from wetting a lower surface of said polishing sheet.

A further aspect of the present invention is a method of chemical mechanical polishing, the method comprising the steps of:

bringing a substrate into contact with a polishing sheet extends over a top major surface of a platen, wherein a hydrophobic layer for substantially preventing an aqueous liquid which penetrates underneath said polishing sheet from wetting a lower surface of said polishing sheet is positioned between said polishing sheet and said top major surface of said platen;

releasably securing said polishing sheet to said platen;

rotating said platen to rotate the polishing sheet and create relative motion between said substrate and said polishing sheet;

releasing said polishing sheet from said platen; and incrementally advancing said polishing sheet in a linear direction across said top major surface of said platen after said polishing step has been completed.

Additional aspects of the present invention will become readily apparent to those skilled in the art from the following detailed description, wherein embodiments of the present invention are described, simply by way of illustration of the best mode contemplated for carrying out the present invention. As will be realized, the present invention is capable of other and different embodiments, and its several details are capable of modification in various obvious respects, all without departing from the present invention. Accordingly, the drawings and description are to be regarded as illustrative in nature, and not as restrictive.

DETAILED DESCRIPTION

Figure 1:
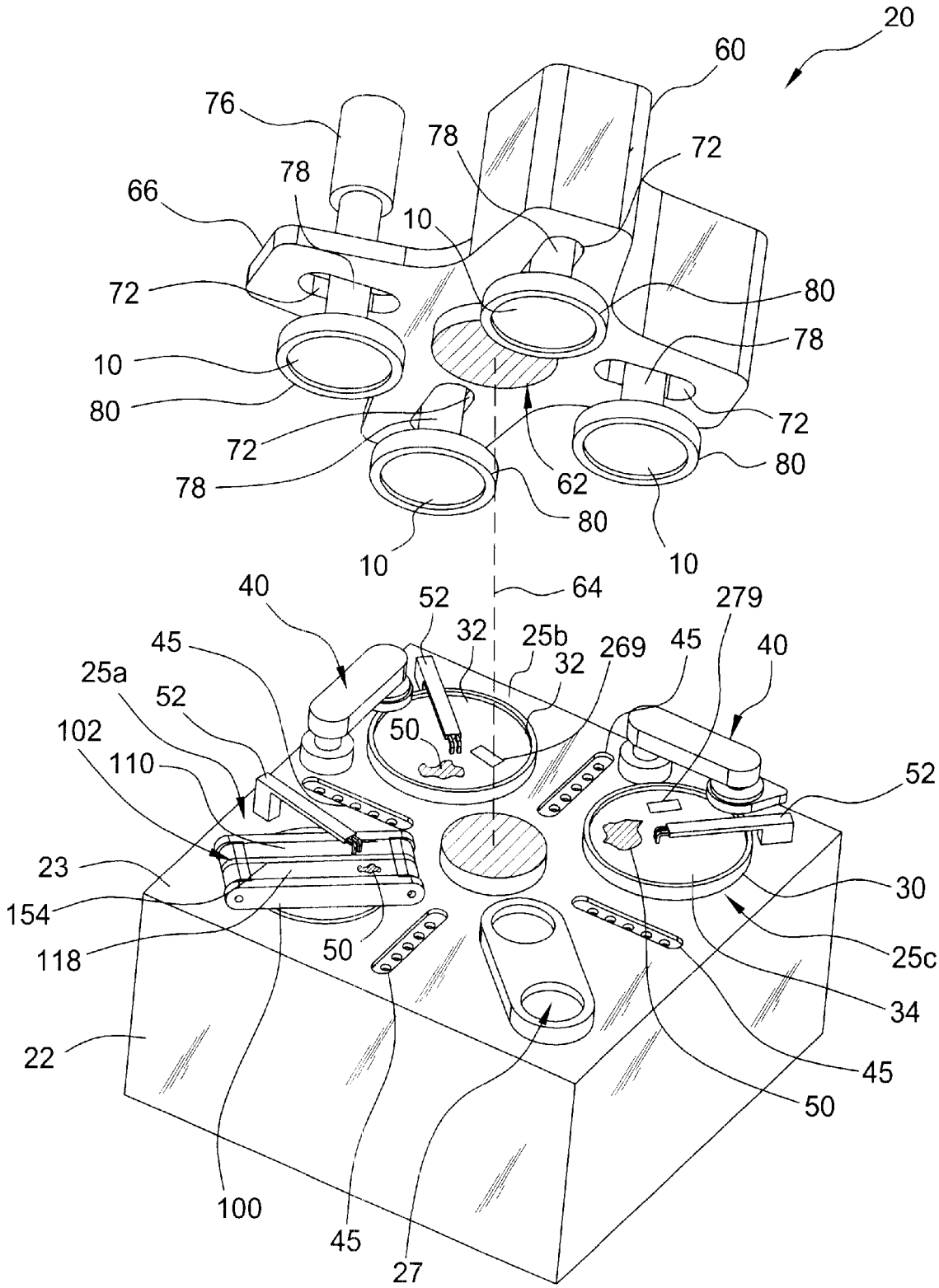
FIG. 1 is a schematic exploded perspective view of a chemical mechanical polishing apparatus.
Figure 2:
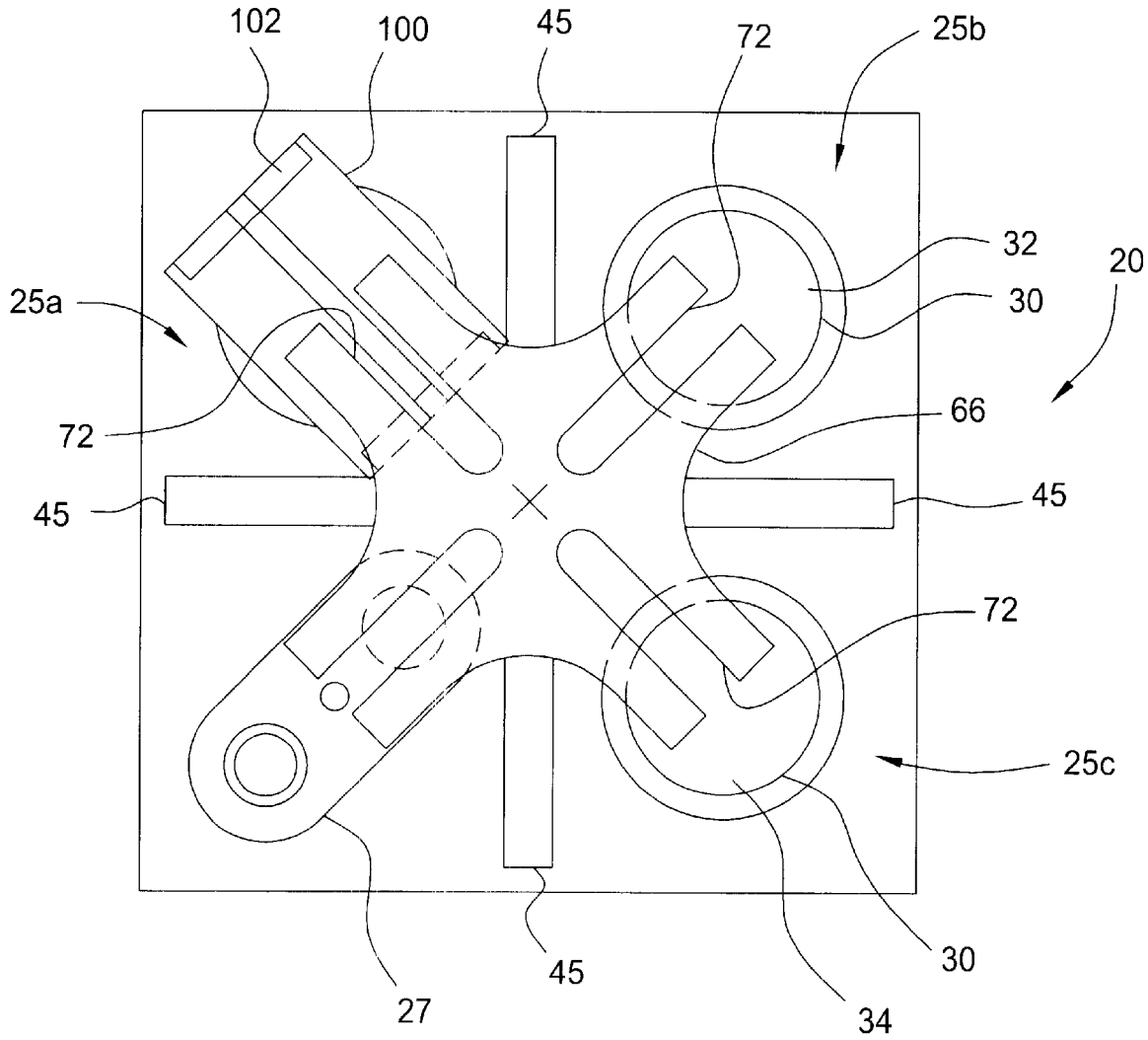
FIG. 2 is a top view of the CMP apparatus of FIG. 1.

With reference to FIGS. 1 and 2, one or more substrates 10 are polished by chemical mechanical polishing apparatus 20. Polishing apparatus 20 includes machine base 22 and table top 23 supporting a series of polishing stations, including first polishing station 25*a*, second polishing station 25*b*, final polishing station 25*c*, and transfer station 27.

At least one of the polishing stations, such as first station 25*a*, includes polishing cartridge 102 mounted to rotatable, rectangular platen 100. The polishing cartridge 102 includes linearly advanceable sheet or belt of fixed-abrasive polishing material. The remaining polishing stations, e.g., second polishing station 25*b* and final polishing station 25*c*, may include "standard" polishing pads 32 and 34, respectively, each adhesively attached to circular platen 30. Each platen may be connected to a platen drive motor (not shown) that rotates the platen at, for example, thirty to two hundred revolutions per minute, although lower or higher rotational speeds may be used. If substrate 10 is an "eight-inch" (200 mm) diameter disk, then rectangular platen 100 may be about twenty inches on a side, and circular platen 30 and polishing pads 32 and 34 may be about thirty inches in diameter.

Polishing stations 25*a*, 25*b* and 25*c* also include combined slurry/rinse arm 52 projecting over the associated polishing surface. Each slurry/rinse arm 52 may include two or more slurry supply tubes to provide a polishing liquid, slurry, or cleaning liquid to the surface of the polishing pad. For example, the polishing liquid dispensed onto the fixed-abrasive polishing sheet at first polishing station 25*a* will not include abrasive particles, whereas the slurry dispensed onto the standard polishing pad at second polishing station 25*b* will include abrasive particles. If final polishing station 25*a* is used for buffing, the polishing liquid dispensed onto the polishing pad at that station would not include abrasive particles. Typically, sufficient liquid is provided to cover and wet the entire polishing pad. Each slurry/rinse arm also includes several spray nozzles (not shown) which provide a high-pressure rinse at the end of each polishing and conditioning cycle.

The polishing stations that include a standard polishing pad, i.e., polishing station 25*b* and 25*c*, may include an optional associated pad conditioner apparatus 40. The polishing stations that include a fixed-abrasive polishing pad, i.e., polishing station 25*a*, may include an optional cleaning apparatus (not shown) to remove grit or polishing debris from the surface of the polishing sheet. The cleaning apparatus may include a rotatable brush to sweep the surface of the polishing sheet and/or a nozzle to spray a pressurized cleaning liquid, e.g., deionized water, onto the surface of the polishing sheet. The cleaning apparatus can be operated continuously, or between polishing operations. In addition, the cleaning apparatus can be stationary, or it can sweep across the surface of the polishing sheet.

In addition, optional cleaning stations 45 may be positioned between polishing stations 25*a* and 25*b*, between polishing stations 25*b* and 25*c*, between polishing station 25*c* and transfer station 27, and/or between transfer station 27 and polishing station 25*a*, to clean the substrate as it moves between the stations.

Rotatable multi-head carousel 60 is supported above the polishing stations by center post 62 and is rotated about carousel axis 64 by a carousel motor assembly (not shown). Carousel 60 includes four carrier head systems mounted on a carousel support plate 66 at equal angular intervals about carousel axis 64. Three of the carrier head systems receive and hold substrates, and polish them by pressing them against the polishing sheet of station 25*a* and the polishing pads of stations 25*b* and 25*c*. One carrier head system receives a substrate from and delivers a substrate to transfer station 27.

Each carrier head system includes carrier or carrier head 80. Carrier drive shaft 78 connects carrier head rotation motor 76 (shown by the removal of one quarter of the carousel cover) to carrier head 80 so that each carrier head can independently rotate about its own axis. In addition, each carrier head 80 independently laterally oscillates in radial slot 72 formed in carousel support plate 66. Carrier head 80 performs several mechanical functions, including holding the substrate against the polishing surface, evenly distributing a downward pressure across the back surface of the substrate, transferring torque from the drive shaft to the substrate, and ensuring that the substrate does not slip out from beneath the carrier head during polishing operations.

Figure 3A:
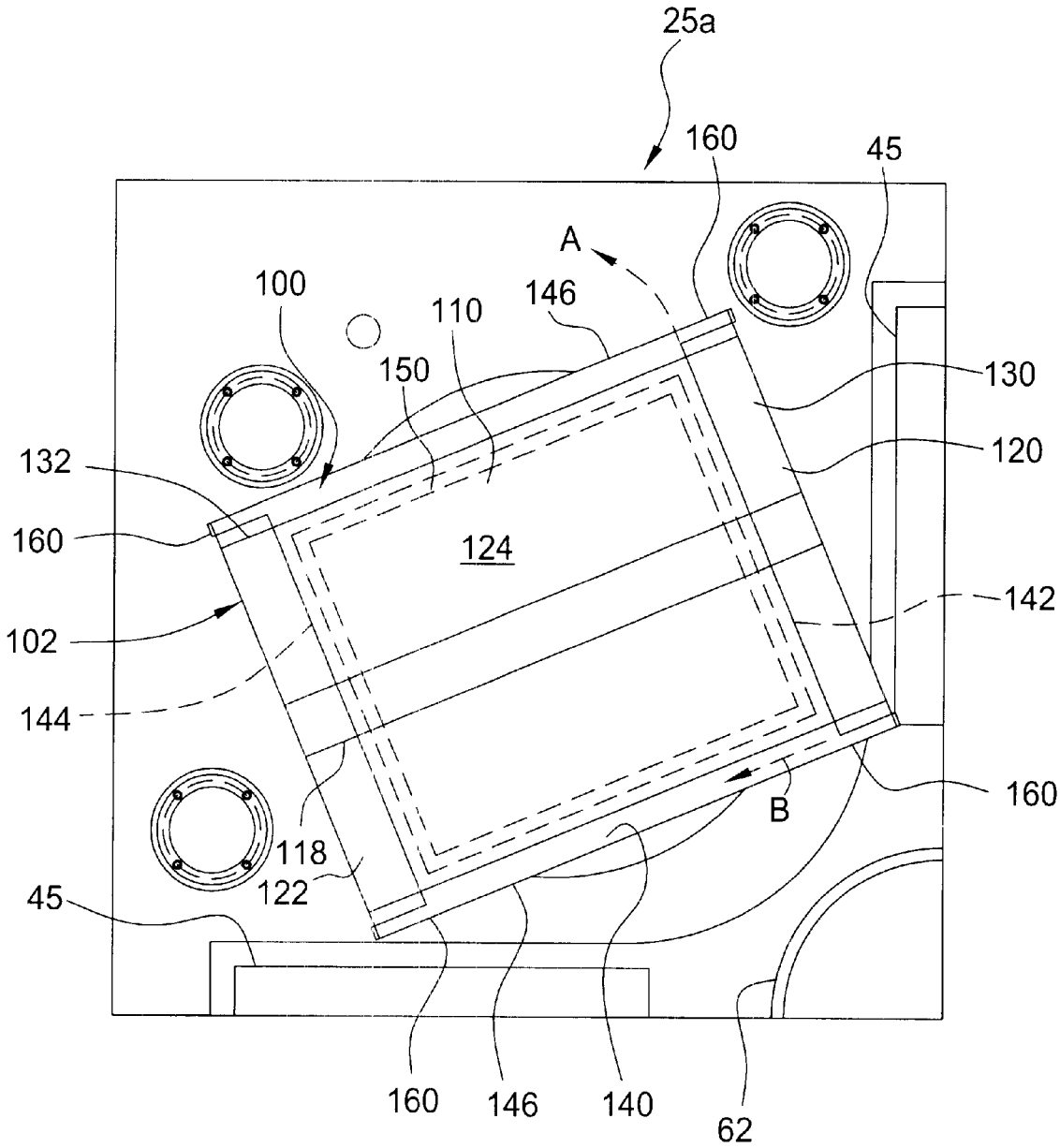
FIG. 3A is a top view of the first polishing station of the CMP apparatus of FIG. 1.
Figure 3B:
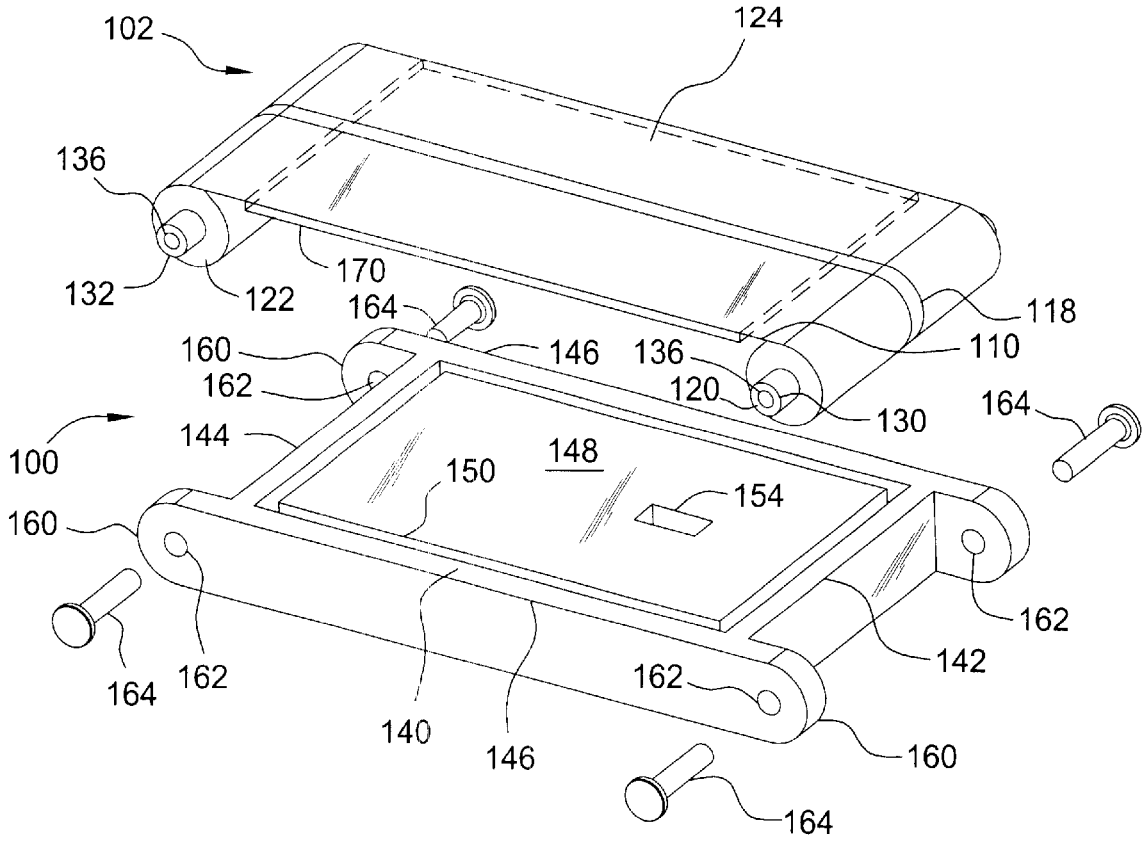
FIG. 3B is a schematic exploded perspective view of a rectangular platen and a polishing cartridge.
Figure 3C:
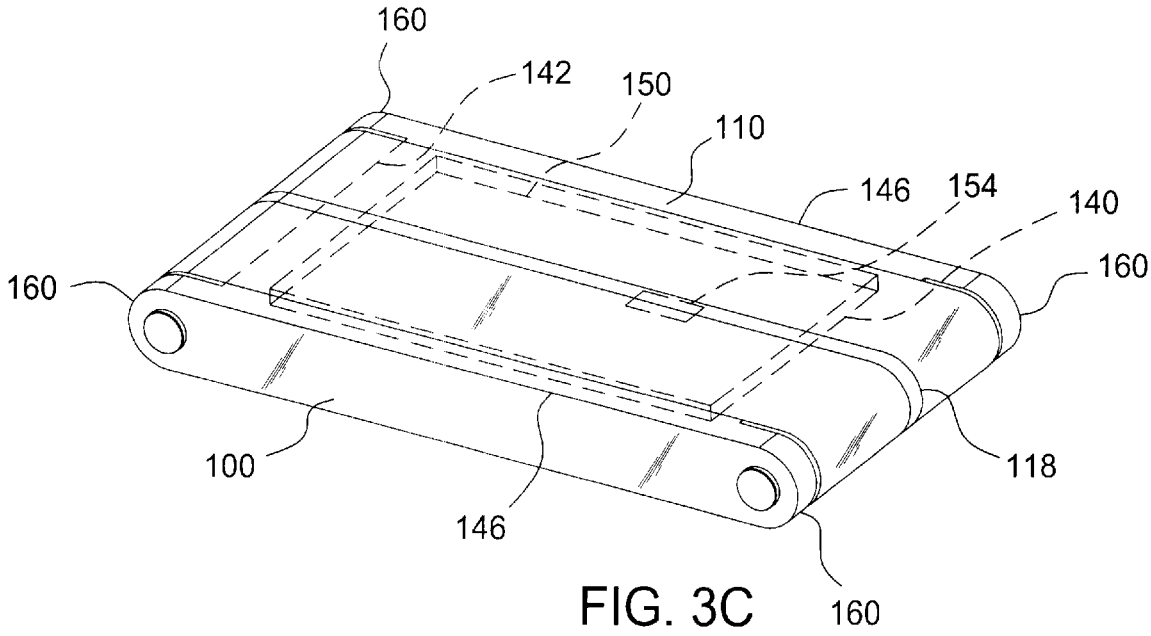
FIG. 3C is a schematic perspective view of a polishing cartridge attached to a rectangular platen.

Referring to FIGS. 3A, 3B, and 3C, polishing cartridge 102 is detachably secured to rectangular platen 100 at polishing station 25*a*. Polishing cartridge 102 includes feed roller 130, take-up roller 132, and generally linear sheet or belt 110, of a polishing pad material. A layer of hydrophobic material 170, such as transparent TEFLON, lines the underside of web 110 and functions to prevent liquid that penetrates underneath the web from wetting the lower surface of the web 110, while allowing optical monitoring. Unused or "fresh" portion 120 of the polishing sheet 110 is wrapped around feed roller 130, and used portion 122 of the polishing sheet is wrapped around take-up roller 132. Rectangular exposed portion 124 of the polishing sheet that is used to polish substrates extends between the used and unused portions 120, 122 over top surface 140 of rectangular platen 100.

Rectangular platen 100 can be rotated (as shown by phantom arrow "A" in FIG. 3A) to rotate the exposed portion of the polishing sheet and thereby provide relative motion between the substrate and the polishing sheet during polishing. Between polishing operations, the polishing sheet can be advanced (as shown by phantom arrow "B" in FIG. 3A) to expose the unused portion of the polishing sheet. When the polishing material advances, polishing sheet 110 unwraps from feed roller 130, moves across the top surface of the rectangular platen, and is taken up by take-up roller 132.

With continued reference to FIGS. 3A, 3B and 3C, a transparent strip 118 is formed along the length of polishing sheet 110. Transparent strip 118 may be positioned at the center of the sheet, and may be about 0.6 inches wide. Transparent strip 118 may be formed by excluding abrasive particles from this region of the containment media during fabrication of the polishing sheet. Transparent strip 118 will be aligned with an aperture or transparent window 154 in rectangular platen 100 to provide optical monitoring of the substrate surface for end point detection, as discussed in greater detail herein. Feed and take-up rollers 130 and 132 should be slightly longer than the width of polishing sheet 110. The rollers 130, 132 may be plastic or metal cylinders and may be, for example, about 20" long and about 2" in diameter.

Rectangular platen 100 includes generally planar rectangular top surface 140 bounded by feed edge 142, take-up edge 144, and two parallel lateral edges 146. Groove 150 (shown in phantom in FIGS. 3A and 3C) is formed in top surface 140. Groove 150 may be a generally rectangular pattern that extends along edges 142–146 of top surface 140. A passage 152 through platen 100 connects groove 150 to a vacuum source 200 (see FIG. 6). When passage 152 is evacuated, exposed portion 124 of polishing sheet 110 is vacuum-chucked to top surface 140 of platen 100. This vacuum-chucking helps ensure that lateral forces caused by friction between the substrate and the polishing sheet during polishing do not force the polishing sheet off the platen. Central region 148 of top surface 140 is free from grooves to prevent potential deflection of the polishing sheet into the grooves from interfering with the polishing uniformity. A sub pad 210 (see FIG. 3D) is placed on the top surface of the platen, for example, to cushion the impact of the substrate against the polishing sheet. In addition, a shim plate 200 (see FIG. 3D) of varying thickness is attached to the platen 100 to adjust the vertical position of the top surface of platen. The sub pad is attached to the shim plate.

Rectangular platen 100 also includes four retainers 160 that hold feed and take-up rollers 130 and 132 at feed and take-up edges 142 and 144, respectively. Each retainer 160 includes aperture 162. At each retainer, pin 164 extends through aperture 162 and into recess 136 (see FIG. 5A) to rotatably connect rollers 130 and 132 to platen 100. To secure polishing cartridge 102 to platen 100, feed roller 130 is slipped into the space between the two retainers along feed edge 142, and two pins 164 are inserted through opposing apertures 162 in retainers 160 to engage the two opposing recesses in the feed roller. Similarly, take-up roller 132 is mounted to platen 100 by slipping it into place between the two retainers along take-up edge 144, and inserting two pins 164 through the opposing apertures 162 to engage the two opposing recesses in the take-up roller.

Figure 3D:
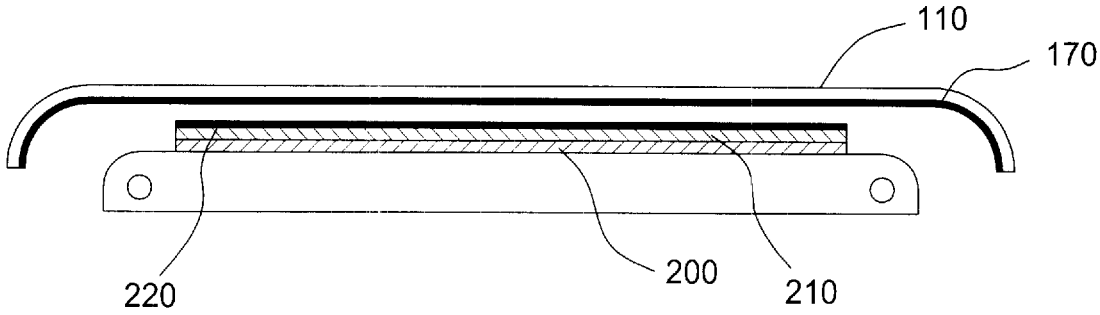
FIG. 3D is a side view of a polishing stack according to an embodiment of the present invention.

Adverting to FIG. 3D, shim plate 200 is disposed on the top surface 140 of rectangular platen 100. Shim plate 200 can comprise a metal and can have a thickness of, for example, about ¼". Sub pad 210 lines the upper surface of the shim plate. A layer of hydrophobic material 220, such as TEFLON, lines the upper surface of sub pad 210 and functions to prevent liquid that penetrates underneath the web from wetting the lower surface of the web 110. With continued reference to FIG. 3D, a layer of hydrophobic material 170, such as TEFLON, lines the underside of web 110 and functions to prevent liquid that penetrates underneath the web from wetting the lower surface of the web 110. The layer of hydrophobic material may be, for example, adhesively affixed to the underside of the web. The present invention contemplates the presence of a layer of hydrophobic material on either the underside of the web 110, or the upper surface of the sub pad 210, or a layer of hydrophobic material on the underside of the web 110 and the upper surface of the sub pad 210.

Figure 4:
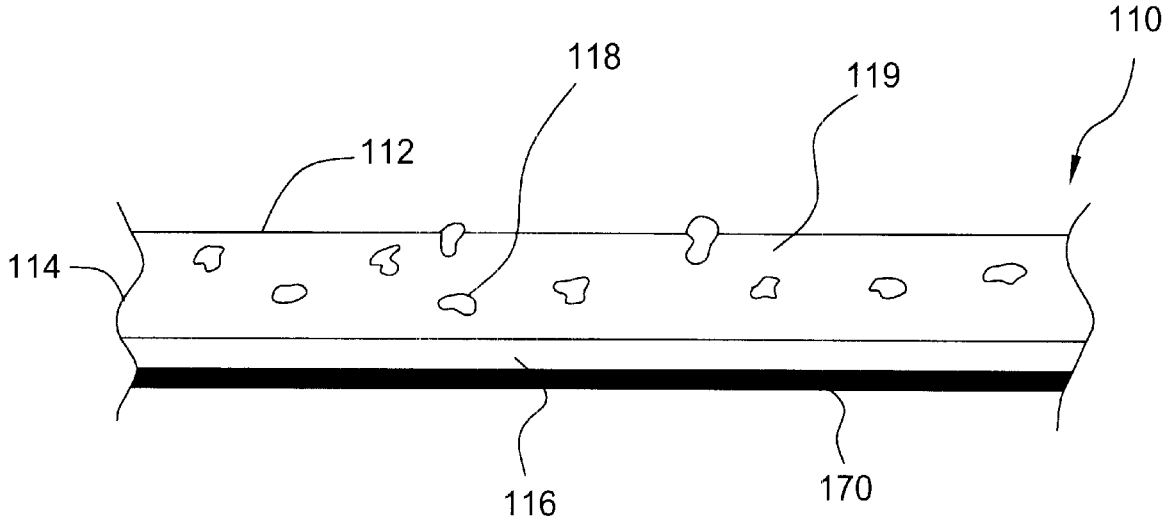
FIG. 4 is a schematic cross-sectional view of a fixed abrasive polishing sheet.

Referring to FIG. 4, polishing sheet 110 can be a fixed-abrasive polishing pad having a polishing surface 112. The fixed-abrasive polishing pad may be about twenty inches wide and about 0.005 inches thick. The fixed-abrasive polishing pad may include an upper layer 114 and a lower layer 116. Upper layer 114 is an abrasive composite layer composed of abrasive grains held or embedded in a binder material. Lower layer 116 is a backing layer composed of a material such as a polymeric film, paper, cloth, a metallic film or the like. A fixed-abrasive polishing sheet having a polyester belt that carries silicon oxide abrasive particles is available from 3M Corporation of Minneapolis, Minnesota. A layer of hydrophobic material 170, such as TEFLON, lines the underside of web 110 and functions to prevent liquid that penetrates underneath the web from wetting the lower surface of the web 110.

The polishing station can also include a vacuum-chucking mechanism and a polishing sheet advancing mechanism, as described in U.S. patent application Ser. No. 09/244,456, filed Feb. 4, 1999, the entirety of which is incorporated herein by reference.

Figure 5:
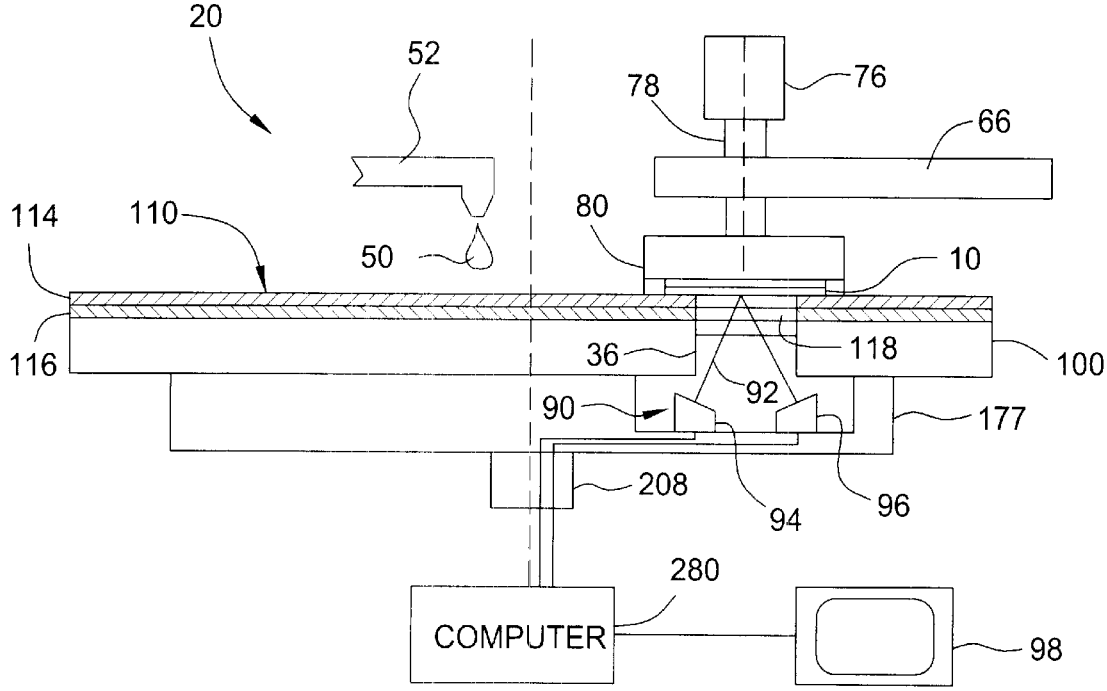
FIG. 5 is a schematic cross-sectional view of a polishing station having an optical endpoint detection system.

Referring to FIGS. 3C and 5, aperture or hole 154 is formed in platen 100 and is aligned with transparent strip 118 in polishing sheet 110. The aperture 154 and transparent strip 118 are positioned such that they have a "view" of substrate 10 during a portion of the platen's rotation, regardless of the translational position of the polishing head. An optical monitoring system 90 is located below and secured to platen 100, e.g., between rectangular platen 100 and platen base 170 so that it rotates with the platen. The optical monitoring system includes a light source 94 and a detector 96. The light source generates a light beam 92 which propagates through aperture 154 and transparent strip 118 to impinge upon the exposed surface of substrate 10.

In operation, CMP apparatus 20 uses optical monitoring system 90 to determine the thickness of a layer on the substrate, to determine the amount of material removed from the surface of the substrate, or to determine when the surface has become planarized. The computer 280 may be connected to light source 94 and detector 96. Electrical couplings between the computer and the optical monitoring system may be formed through rotary coupling 208. The computer may be programmed to activate the light source when the substrate overlies the window, to store measurements from the detector, to display the measurements on an output device 98, and to detect the polishing endpoint.

In operation, exposed portion 124 of polishing sheet 110 is vacuum-chucked to rectangular platen 100. A substrate is lowered into contact with polishing sheet 110 by carrier head 80, and both platen 100 and carrier head 80 rotate to polish the exposed surface of the substrate. After polishing, the substrate is lifted off the polishing pad by the carrier head, the vacuum is removed, and the polishing sheet is advanced. This exposes a fresh segment of the polishing sheet. The polishing sheet is then vacuum-chucked to the rectangular platen, and a new substrate is lowered into contact with the polishing sheet. Thus, between each polishing operation, the polishing sheet may be advanced incrementally. For example, feed roller 130 can be coupled to an adjustable slip clutch which prevents feed roller 130 from rotating to advance polishing sheet 110 unless the applied force is greater than some threshold force, while also preventing feed roller 130 from rotating "backwards". At the same time, take-up roller 132 can be coupled to a motor which cooperates with the slip clutch to normally maintain polishing sheet 110 in a state of tension. Additionally, a mechanism (e g., a movable door or flap) can be provided to create slack in polishing sheet 110 between feed roller 130 and the adjustable slip clutch while polishing sheet 110 is vacuum-chucked to the platen. Then, when the vacuum is removed, the motor will advance polishing sheet 110 only by the amount played out when the slack was created, exposing a fresh segment of polishing sheet 110. Furthermore, if the polishing station includes a cleaning apparatus, the polishing sheet may be washed between each polishing operation.

The amount that the sheet may be advanced will depend on the desired polishing uniformity and the properties of the polishing sheet, but should be on the order of 0.05 to 1.0 inches, e.g., 0.4 inch, per polishing operation. Assuming that the exposed portion 124 of polishing sheet is 20 inches long and the polishing sheet advances 0.4 inches after each polishing operation, the entire exposed portion of the polishing sheet will be replaced after about fifty polishing operations.

Figure 6:
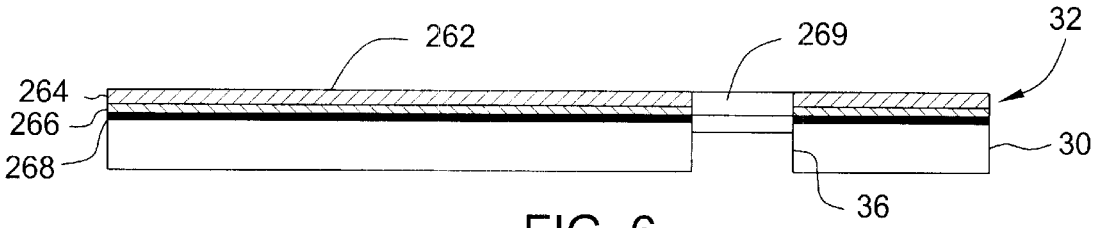
FIG. 6 is a schematic cross-sectional view of a platen and polishing pad of a second polishing station.

Referring to FIG. 6, at second polishing station 25*b*, the circular platen may support a circular polishing pad 32 having a roughed surface 262, an upper layer 264 and a lower layer 266. Lower layer 266 may be attached to platen 30 by a pressure-sensitive adhesive layer 268. Upper layer 264 may be harder than lower layer 266. For example, upper layer 264 may be composed of microporous polyurethane or polyurethane mixed with a filler, whereas lower layer 266 may be composed of compressed felt fibers leached with urethane. A two-layer polishing pad, with the upper layer composed of IC-1000 or IC-1400 and the lower layer composed of SUBA-4, is available from Rodel, Inc. of Newark, Del. (IC-1000, IC-1400 and SUBA-4 are product names of Rodel, Inc.). A transparent window 269 may be formed in polishing pad 32 over an aperture 36 in platen 30.

Figure 7:
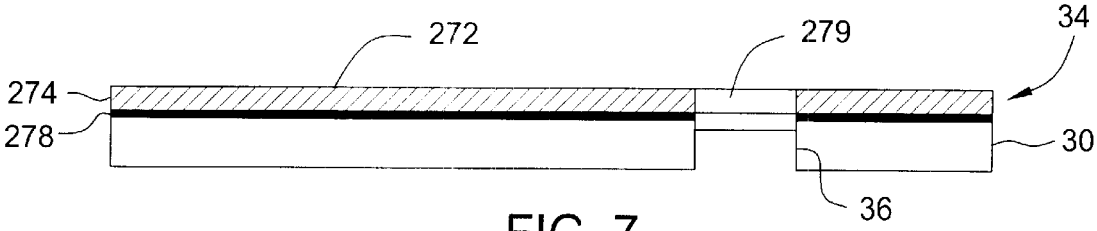
FIG. 7 is a schematic cross-sectional view of a platen and polishing pad of a final polishing station.

Referring to FIG. 7, at final polishing station 25*c*, the platen may support a polishing pad 34 having a generally smooth surface 272 and a single soft layer 274. Layer 274 may be attached to platen 30 by a pressure-sensitive adhesive layer 278. Layer 274 may be composed of a napped poromeric synthetic material. A suitable soft polishing pad is available from Rodel, Inc., under the trade name Politex. Polishing pads 32 and 34 may be embossed or stamped with a pattern to improve distribution of slurry across the face of the substrate. Polishing station 25*c* may otherwise be identical to polishing station 25*b*. A transparent window 279 may be formed in polishing pad 34 over aperture 36.

Although the CMP apparatus is described as vacuum chucking the polishing sheet to the platen, other techniques could be used to secure the polishing sheet to the platen during polishing. For example, the edges of the polishing sheet could be clamped to the sides of the platen by a set of clamps.

Also, although the rollers are described as connected to the retainers by pins that are inserted through apertures, numerous other implantations are possible to rotatably connect the rollers to the platen. For example, a recess could be formed on the inner surface of the retainer to engage a pin that projects from the end face of the roller. The retainers 160 may be slightly bendable, and the rollers might be snap-fit into the retainers. Alternately, the recess in the inner surface of the retainer could form a labyrinth path that traps the rollers due to tension. Alternately, the retainer could be pivotally attached to the platen, and the roller could engage the retainer once the retainer is locked in position.

In addition, although the CMP apparatus is described as having one rectangular platen with a fixed-abrasive polishing sheet and two circular platens with standard polishing pads, other configurations are possible. For example, the apparatus can include one, two or three rectangular platens. In fact, one advantage of CMP apparatus 20 is that each platen base 170 is adaptable to receive either a rectangular platen or a circular platen. The polishing sheet on each rectangular platen may be a fixed abrasive or a non-fixed abrasive polishing material. Similarly, each polishing pad on the circular platen can be a fixed-abrasive or a non-fixed abrasive polishing material. The standard polishing pads can have a single hard layer (e.g., IC-1000), a single soft layer (e.g., as in a Polytex pad), or two stacked layers (e.g., as in a combined IC-1000/SUBA IV polishing pad). Different slurries and different polishing parameters, e.g., carrier head rotation rate, platen rotation rate, carrier head pressure, can be used at the different polishing stations.

One implementation of the CMP apparatus may include two rectangular platens with fixed-abrasive polishing sheets for primary polishing, and a circular platen with a soft polishing pad for buffing. The polishing parameters, pad composition and slurry composition can be selected so that the first polishing sheet has a faster polishing rate than the second polishing sheet.

In the previous description, numerous specific details are set forth, such as specific materials, structures, chemicals, processes, etc., to provide a better understanding of the present invention. However, the present invention can be practiced without resorting to the details specifically set forth. In other instances, well known processing and materials have not been described in detail in order not to unnecessarily obscure the present invention.

Only the preferred embodiment of the present invention and but a few examples of its versatility are shown and described in the present disclosure. It is to be understood that the present invention is capable of use in various other combinations and environments and is capable of changes or modifications within the scope of the inventive concept as expressed herein.

What is claimed:

1. A chemical mechanical polishing apparatus, comprising:

a platen having a flat planar major surface, said platen being rotatable about an axis normal to said major surface;

a hydrophobic layer coupled to said top major surface of said platen; and a polishing sheet releasably secured to a top of said major surface of said platen to rotate with said platen, said polishing sheet extending over said top of said major surface of said platen and having an exposed surface for polishing a substrate, said polishing sheet adapted to be advanced across said platen and said hydrophobic layer.

2. The apparatus of claim 1, wherein said hydrophobic layer is integrally bonded to said top of said major surface of said platen.

3. The apparatus of claim 2, wherein at least one intermediate member selected from the group consisting of a sub pad and a shim plate is disposed on said major surface of said platen and said hydrophobic layer.

4. The apparatus of claim 2, wherein said intermediate layer further comprises a second hydrophobic layer coupled thereto and disposed adjacent said polishing sheet.

5. The apparatus of claim 1, wherein said hydrophobic layer is comprised of TEFLON®.

6. The apparatus of claim 1, wherein said apparatus includes a second hydrophobic layer integrally bonded to a lower surface of said polishing sheet.

7. The apparatus of claim 1, wherein said polishing sheet can be incrementally advanced by unwrapping a segment of an unused portion of said polishing sheet from a feed roller.

8. The apparatus of claim 1, wherein said polishing sheet can be incrementally advanced by wrapping a segment of an exposed portion of said polishing sheet around a take-up roller.

9. The apparatus of claim 1, wherein a transparent region is formed in said polishing sheet.

10. The apparatus of claim 9, wherein said platen includes an aperture aligned with said transparent region in said polishing sheet.

11. The apparatus of claim 10, further comprising an optical monitoring system to direct light through said aperture and said transparent region to impinge said substrate.

12. The apparatus of claim 1, wherein said polishing sheet comprises a fixed-abrasive polishing material.

13. A method of chemical mechanical polishing, the method comprising the steps of:

bringing a substrate into contact with a polishing sheet extending over a top major surface of a platen, wherein a hydrophobic layer is positioned between said polishing sheet and said top of said major surface of said platen;

releasably securing said polishing sheet to said platen;

rotating said platen to rotate said polishing sheet and create relative motion between said substrate and said polishing sheet;

releasing said polishing sheet from said hydrophobic layer; and advancing said polishing sheet in a linear direction across said top major surface of said platen and said hydrophobic layer after said polishing step has been completed.

14. The method of claim 13, wherein a second hydrophobic layer is integrally bonded to a lower surface of said polishing sheet.

15. The method of claim 13, wherein said hydrophobic layer is integrally bonded to said top of said major surface of said platen.

16. The method of claim 13, wherein said securing step includes vacuum-chucking said polishing sheet to said platen.

17. The method of claim 13, wherein step of advancing further comprises incrementally advancing said polishing sheet.

18. A chemical mechanical polishing apparatus comprising:

a platen having a support surface;

a hydrophobic layer disposed on the support surface; and an advancable polishing sheet disposed across the hydrophobic layer and adapted to be moved across the hydrophobic layer.

19. The chemical mechanical polisher of claim 18, wherein the hydrophobic layer is bonded to the platen.

20. A method of chemical mechanical polishing comprising:

supporting a polishing sheet on a hydrophobic layer coupled to a platen;

contacting a substrate to the polishing sheet;

moving the substrate and the polishing sheet relative to each other;

removing the substrate from the polishing sheet; and advancing the polishing sheet across the hydrophobic layer.

21. A method of chemical mechanical polishing comprising:

supporting a polishing sheet on a hydrophobic layer coupled to a platen;

contacting a substrate to the polishing sheet;

moving the substrate and the polishing sheet relative to each other; and advancing the polishing sheet over the hydrophobic layer.

22. A chemical mechanical polishing apparatus, comprising:

a platen rotatable about an axis normal to a top surface of the platen;

a hydrophobic layer disposed on the top surface of said platen; and a polishing sheet releasably secured to the hydrophobic layer and adapted to be advanced across said platen and said hydrophobic layer.

23. The apparatus of claim 22, wherein hydrophobic layer is selected from the group consisting of a sub pad and a shim plate is disposed in a recess formed in the top surface of said platen.

* * * * *